United States Patent [19]

Kirchner

[11] Patent Number: 4,620,675

[45] **Date of Patent: * Nov. 4, 1986**

[54] COMPOSITE FLEXIBLE PULP REFINER DISK

[75] Inventor: Edward C. Kirchner, Pittsfield, Mass.

[73] Assignee: Beloit Corporation, Beloit, Wis.

[ * ] Notice: The portion of the term of this patent subsequent to Jul. 30, 2002 has been disclaimed.

[21] Appl. No.: 530,008

[22] Filed: Sep. 7, 1983

[51] Int. Cl.[4] ..... B02C 7/14

[52] U.S. Cl. ..... 241/261.3; 241/296

[58] Field of Search ..... 241/DIG. 30, 261.2, 241/261.3, 300, 296, 297, 298, 146, 285 R

[56] References Cited

U.S. PATENT DOCUMENTS

| | | | |
|---|---|---|---|
| 360,670 | 4/1887 | Etnier, Jr. | 241/DIG. 30 X |
| 2,567,448 | 9/1951 | Rickerich, Jr. et al. | 241/296 |
| 3,117,603 | 1/1964 | Van Keuren et al. | 241/298 |
| 3,326,480 | 6/1967 | Jones | 241/297 X |
| 4,102,505 | 7/1978 | Del Sarto | 241/297 |
| 4,531,681 | 7/1985 | Matthew et al. | 241/261.3 X |

*Primary Examiner*—Mark Rosenbaum

*Attorney, Agent, or Firm*—Hill, Van Santen, Steadman & Simpson

[57] ABSTRACT

Improved thickness tolerance, easier assembling and substantial economies are attained by constructing resiliently flexible refiner disks by affixing refining surface ring plates to the disk margins by structural bonding agent, epoxy being preferred. In making the refining disk assembly, the disk may be formed from fiberglass or fiberglass-epoxy composite or stainless steel and the epoxy adhered assembly cured in a curing zone wherein, if the disk is formed from an uncured fiberglass material, the disk may be cured at the same time as the bonding agent.

8 Claims, 3 Drawing Figures

COMPOSITE FLEXIBLE PULP REFINER DISK

BACKGROUND OF THE INVENTION

1. Field of the Invention

The present invention relates to refiners especially useful for refining paper pulp, and is more particularly concerned with certain new and improved flexible refining disks for such refiners, and the method of making such disks.

2. Description of Prior Art

Conventional methods of refining paper stock, as it comes from beaters, digesters, or other pulping apparatus, generally involve passing the stock between rigid grinding or refining surfaces which break up the fibrous material and effect some further separation and physical modification of the fibers.

Substantial improvements in refiners for this purpose are disclosed in the copending application for patent of John B. Matthew and Edward C. Kirchner, Ser. No. 486,006 filed Apr. 18, 1983, now U.S. Pat. No. 4,531,618, issued July 30, 1985, and assigned to the same assignee as the present application. According to that application, the rigidity constraints typically theretofore required in rotary disk refiners is overcome and substantial improvements in structure and operation are attained by the provision of resiliently flexible refining surface-supporting disks permitting operating pressure responsive adjustment of the relatively rotating refining surfaces axially relative to one another for attaining optimum material working results from the refining surfaces. More particularly, the resiliently flexible refining surface-supporting means comprise annular disk-supporting ring-shaped refining surface plates of limited radial width which are mounted in sandwiching relation to margins of the disks while the opposite margins of the disks are equipped for fixed attachment in the refiner apparatus. The refining surface plates are secured to the disk margins by mechanical means comprising screws, but which may also comprise rivets. However, such mode of securement involves considerable machining such as drilling, tapping and securement of the fasteners. Certain thickness tolerance problems in these modes of securement diminish the desired tolerance precision in the disk assembly in the refiner. Precision is highly desirable for attaining optimum results in the close cooperation of the refining surfaces required for paper pulp refining. It is to the alleviation of such problems that the present invention is primarily directed.

SUMMARY OF THE INVENTION

An object of the present invention is to provide substantial improvements in flexible disk structure in apparatus especially useful in refining paper pulp.

Another object of the invention is to provide improvements in the mounting of refining ring plates on flexible refining disks.

A further object of the invention is to provide a new and improved bonding of refiner ring plates to flexible refining disks, avoiding need for any other kind of securing means.

In accordance with the principles of the present invention, there is provided in an apparatus for reducing particulate material by means of a plurality of radially extending relatively rotatable and axially confronting refining surface means between which the material is caused to flow while being refined during relative rotation of said surface means, and means for effecting flow of the material radially between and across said surface means, at least one axially resiliently flexible annular refining disk providing a part of said refining surface means and having opposite margins and means for securing the disk in an operative relation in the apparatus, a pair of refining ring plates of substantially less radial width than said disk and having faces opposing one another and sandwiching the opposite margin of said disk and providing oppositely facing refining surfaces for the disk, a tenacious structural bonding agent film between said opposite margin and each of said sandwiching faces and fixedly securing said refining ring plates to said opposite margin, and said bonding agent film being the sole means for securing said ring plates to said other margin, and thereby avoiding need for any other kind of securing means.

The invention also provides for use in an apparatus for reducing particulate material by means of a plurality of radially extending relatively rotatable and axially confronting refining surface means between which the material is caused to flow while being refined during relative rotation of said surface means, an axially resiliently flexible annular refining disk for providing a part of said refining surface means and having opposite margins and means at one margin for securing the disk in an operative relation in the apparatus, a pair of refining ring plates of substantially less radial width than said disk and having faces opposing one another and sandwiching the opposite margin of said disk providing oppositely facing refining surfaces for the disk, and a tenacious structural bonding agent film between said opposite margin and each of said sandwiching faces and fixedly securing said refining ring plates to said opposite margin, and said bonding agent film being the sole means for securing said ring plates to said other margin, and thereby avoiding need for any other kind of securing means.

BRIEF DESCRIPTION OF THE DRAWINGS

Other objects, features and advantages of the present invention will be readily apparent from the following description of representative embodiments thereof, taken in conjunction with the accompanying drawing, although variations and modifications may be effected without departing from the spirit and scope of the novel concepts embodied in the disclosure, and in which.

DETAILED DESCRIPTION

Figure 1:
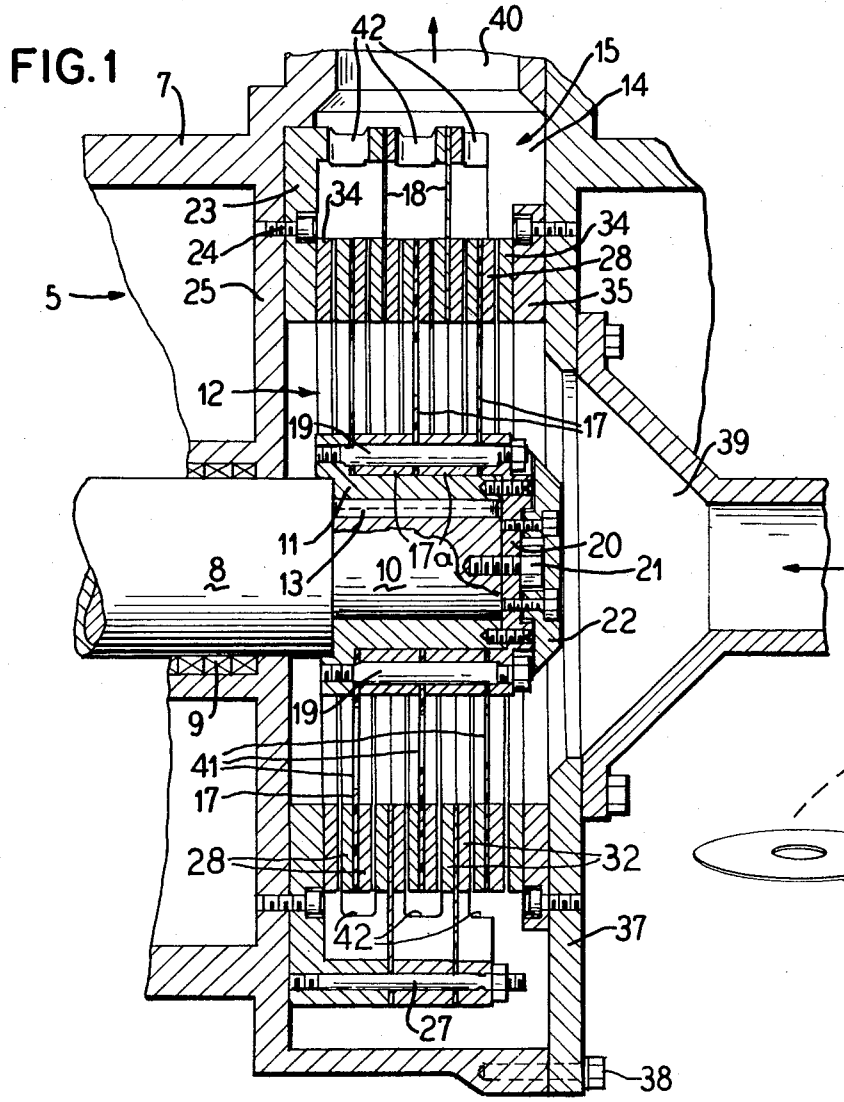
FIG. 1 is a longitudinal sectional elevational view through a flexible disk pulp refiner embodying features of the invention.
Figure 2:
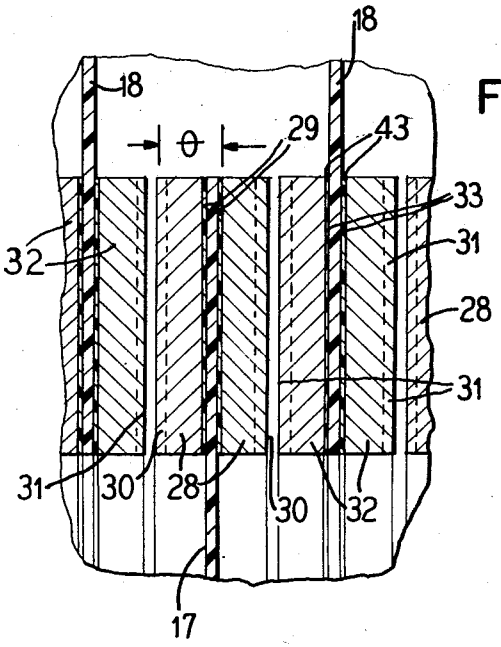
FIG. 2 is a fragmentary substantially enlarged detail view of a portion of the refining disk assembly, taken in the same plane as FIG. 1.

A flexible disk refiner assembly 5 in which the present invention is embodied, is adapted for reducing and fibrillating various fibrous materials into individual fibers, and is particularly adapted for use in the paper making industry for refining woodpulp in preparing paper making stock. Although a single unit of the refiner assembly has been shown by way of example, it will understood that a series of refiner assemblies according to the invention may be employed where, in the pulp refining process, the pulp fibers must be progressively reduced.

In a preferred arrangement, the assembly 5 includes a stationary chambered housing 7 in which a shaft 8 is supported for rotation on conventional bearing means including a bearing structure 9, the shaft being driven in any suitable manner as for example by means of a motor (not shown). A shaft stub 10 is provided as a coaxial extension on the free end of th shaft 8. A hub 11 for a refining rotor 12 is secured as by means of a key 13 corotatively to the stub 10. In rotation of the shaft 8, the rotor 12 is rotated within a refiner working chamber 14 defined by and within the housing 7. Mounted within the chamber 14 and cooperating with the rotor 12 is a refining stator 15. Although the rotor 12 may comprise one resiliently flexible annular refining disk 17, cooperating with a plurality of annular resiliently flexible stator refining disks 18 of suitably larger inside and outside diameter, a single one of the rotor disks 17 may simply cooperate with stationary refining structure in the stator assembly 15. In the illustrated instance, three of the rotor disks 17 cooperate in an interdigitated mode with two of the stator disks 18 and in addition with stationary refining structure of the stator, although there may be more or less of the cooperating rotor and stator disks, as may be desired.

In a desirable arrangement, the rotor disks 17 are mounted to the hub 11 in accurately longitudinally spaced relation by means at one edge, herein their radially inner edges, which receive the hub 11 therethrough. Bolts 19 and suitable spacers **17*a* intervening between the disk margins along the bolts 19 secure the disks 17 to the hub 11. A retainer plate 20 is secured as by means of a bolt 21 to the terminal end of the stub 10, and a protective cap 22 is secured over the assembly at the stub end. Support for the stator disks 18, coaxially cooperative with the rotor disks 17, is provided by means of an annular mounting plate 23 secured as by means of screws 24 to a radially extending wall 25 defining the inner side of the chamber 14. Bolts 27 secure radially outer margins of the stator disks 18 to the mounting plate 23**.

At their adjacent, spacedly interleaved margins, the stator and rotor disks have refining plate means. For this purpose, each of the rotor disks 17 carries on its radially outer margin a pair of annular refining ring plates 28, of substantially less radial width than the disks 17. The plates 28 have faces 29 opposing one another and sandwiching the margin of the disk 17. Oppositely facing refining surfaces 30 on the refining plates 28 cooperate in closely gapped relation with confronting refining surfaces 31 on adjacent refining ring plates 32 of the same diameter and carried by the stator disks 18. Similarly as the plates 28, the refining plates 32 have confronting faces 33 opposing one another and sandwiching the associated margin of the disk 18 whereby the oppositely facing refining surfaces 31 of the plates 32 are adapted for cooperation with the refining surfaces 30 of the plates 28.

At the opposite ends of the rotor 12, the endmost refining disks 17 have the refining surfaces of the endmost refining ring plates 28 in cooperative refining gap relation with respect to concentric, coextensive refining ring plates 34 comprising part of the stator assembly and supported by the stator support 23 at one end of the assembly and by a mounting ring 35 at the opposite end of the assembly. The mounting ring 35 is carried by a closure plate 37 secured as by means of bolts 38 to the housing 7 and defining the side of the chamber 14 opposite to the wall 25.

Pulp stock to be refined is delivered to the chamber 14 by way of an inlet 39 entering the chamber 14 coaxially with the rotor 12 for uniformly traversing the refining zone provided by the cooperating rotor and stator refining disks, and more particularly their cooperating axially facing refining plate surfaces between which all of the stock must pass enroute to an outlet 40 which may, as shown, extend generally radially or tangentially from the chamber 14. To facilitate uniform stock flow and refining, the rotor disks 17 are desirably provided with openings 41 therethrough and which may be progressively larger size from the disks 17 nearest the inlet 39, to the disk 17 at the opposite side of the chamber 14. After the stock has passed radially through the grinding, refining gaps provided cooperatively by the rotor and stator refining surfaces, the refined stock passes toward the outer circumference of the chamber 14 by way of passageway provided by radially opening ports 42 through the stator disk supporting structure, and then leaving the chamber 14 through the outlet 40. Of course, if desired, the direction of refining flow of the stock to be treated may be reversed, whereby the outlet 40 may become the inlet and the inlet 39 may become the outlet. Also, if preferred, the order of rotor and stator may be reversed, that is the rotor 12 may be constructed as a stator and the stator 15 may become a rotor, depending on preference.

By virtue of their axial resilient flexibility, the refining disks 17 and 18 are especially desirable for attaining efficient self-alignment and self-centering for uniformity of refining action between the refining surfaces of the ring plates carried by the disks. In other words, the disks 17 and 18 are responsive to dynamic fluid pressure exerted by the material traversing the refining gaps during relative rotation of the refining disks together with their refining plates. In a practical construction, where the rotor refining disks 17 are about eighteen inches in outside diameter and the stator disks 18 are about twenty-four inches in outside diameter, and the ring plates 28, 32 and 34 are of about eighteen inches outside diameter and fourteen inches inside diameter, a desirable thickness for all the disks 17 and 18 may be about 0.070 inch where the disks are made from fiberglass. On the other hand, the refining ring plates 28, 32 and 34 may be made from stainless steel with an overall thickness of about 0.375 inch each and their refining surfaces may comprise ribs or bars of about 0.062 inch height and width, and spaced apart about 0.187 inch, and canted in the desired direction from the radially inner to the radially outer edges of the plates.

Substantial improvement in affixing the refining ring plates 28 and 32 to their respective refining disks 17, 18 is accomplished by bonding the plates to the disks, rather than attaching the plates to the disks by mechanical means. Preferably such bonding is effected by means of a tenacious structural bonding agent such as an epoxy adhesive applied as a fixedly securing film 43 between the plate supporting margin of each of the disks 17 and 18 and the sandwiching faces 29 in respect to the disks 17 and the sandwiching faces 33 in respect to the disks 18. Not only is such bonding of the refiner plates to the disks an easier and more economical mode of attachment, but the structural bonding adhesive provides a glue line that acts as an integrator for any surface non-uniformity, that is, it will compensate for any surface non-uniformity and thus assist in attaining critical thickness tolerance for the disk/refiner plate assembly in each instance.

In addition, where the material of the disks 17 and 18 is adapted to be cured in the same manner as the bonding agent, the disk/refiner plate composite or assembly may be adapted to curing in one operation. For example, where the material of the disks 17 and 18 is a fiberglass/epoxy composite and the bonding agent is an epoxy adhesive, a curing of the disks and the bonding agent at the same time becomes a practicality. Of course, if necessary, the disks may be fully prefabricated and then assembled and bonded to the refining ring plates.

Figure 3:
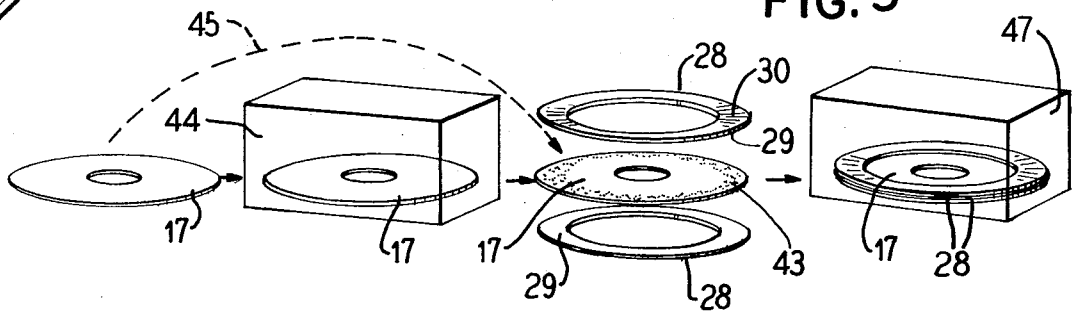
FIG. 3 is a schematic illustration showing steps in the manufacture of flexible refining disks according to the present invention.

As exemplified in FIG. 3, the rotor refining disks 17 may be fabricated in any preferred manner, from any preferred material, such as but not limited to stamping from desired gauge fiberglass or fiberglass/epoxy sheet material, or molded from such material, or the like. If preferred, the uncured disks 17 may be cured in a curing zone 44, or if desired may bypass the curing zone 44 as indicated by the bypass arrow 45. Whether cured or uncured, the disks 17 are then supplied with the structural bonding agent 43 such as epoxy in a suitable thin uncured film on both sides of the disks in the area to be engaged by the sandwiching faces 29 of the ring plates 28, or the bonding agent film may be applied to the sandwiching faces of the refiner ring plates. The ring plates are then assembled with the disks 17, and the composite or assembly is introduced into a curing zone 45 wherein the bonding agent films, which may have been permitted to set before entering the zone 45, are cured, and where desired the disks 17 may also be simultaneously cured. The bonding films 43 then tenaciously, fixedly secure the refining ring plates to the margins of the disks. It will be understood, of course, that the same method is adapted for attaching the refining ring plates 32 to the stator disks 18.

Although a preferred material for the refining disks 17 and 18 is fiberglass or fiberglass-epoxy composite, it may be preferred to use other materials having high strength to modulus elasticity ratio, such as Scotchply reinforced plastic type 1002 Crossply, or other suitable materials such as spring stainless steel, or the like. Selection of material and thickness should be such that the disks are capable of axial resilient deflections, i.e., flexibility, but possessed of thorough resistance to radial and circumferential deflection, so as to effectively withstand torque and centrifugal loads in operation. As to the refining ring plates, although stainless steel has been mentioned, the material should be a relatively hard and relatively inflexible wear-resistant material such as ni-hard stainless steel, ceramic, or the like.

Securing of the ring plates to the respective disk margins solely by means of a bonding agent avoids need for any other kind of securing means such as screws, wedges, and the like.

It will be understood that variations and modifications may be effected without departing from the spirit and scope of the novel concepts of this invention.

I claim as my invention:

1. In an apparatus for reducing particulate material by means of a plurality of radially extending relatively rotatable and axially confronting refining surface means between which the material is caused to flow while being refined during relative rotation of said surface means, and means for effecting flow of the material radially between and across said surface means;

at least one annular refining disk which is in and of itself axially resiliently flexible between its radially opposite margins and providing a part of said refining surface means and having means at one margin for securing the disk in an operative relation in the apparatus, said disk having flat opposing faces;

a pair of refining ring plates of substantially less radial width than said disk and having flat faces opposing one another and sandwiching the other margin of said disk therebetween in flat face to flat face abutment and said plates providing oppositely facing refining surfaces for the disk;

a tenacious structural bonding agent film between said other margin and each of said sandwiching faces and fixedly securing said refining ring plates directly to said other margin;

there being a substantial radial extent of said disk between said securing means and said ring plates permitting relative axial displacement of said margins by axial flexing of said substantial radial extent of the disk;

and said bonding agent film being the sole means for securing said ring plates to said other margin, and thereby avoiding need for any other kind of securing means for said ring plates.

2. Apparatus according to claim 1, wherein said refining disk comprises material having a high strength to modulus of elasticity ratio selected from fiberglass, fiberglass/epoxy composite, spring stainless steel; and said refining plate rings comprise a hard and relatively inflexible wear resistant material selected from ni-hard stainless steel and ceramic.

3. Apparatus according to claim 1, wherein said one margin of the disk is at the radially inner perimeter of the disk, and said opposite margin is at the radially outer perimeter of the disk.

4. Apparatus according to claim 1, wherein said one margin of the disk is at the radially inner perimeter of the disk and said opposite margin is at a radially outer perimeter of the disk.

5. For use in an apparatus for reducing particulate material by means of a plurality of radially extending relatively rotatable and axially confronting refining surface means between which the material is caused to flow while being refined during relative rotation of said surface means:

an axially resiliently flexible annular refining disk for providing a part of said refining surface means and having opposite margins with means at one margin for securing the disk in an operative relation in the apparatus, said disk having flat opposing faces;

a pair of refining ring plates of substantially less radial width than said disk and having flat faces opposing one another and sandwiching the other margin of said disk therebetween in flat face to flat face abutment and said plates providing oppositely facing refining surfaces for the disk;

a tenacious structural bonding agent film between said other margin and each of said sandwiching faces and fixedly securing said refining ring plates directly to said other margin;

there being a substantial radial extent of said disk between said securing means and said ring plates permitting relative axial displacement of said margins by axial flexing of said substantial radial extent of the disk;

and said bonding agent film being the sole means for securing said ring plates to said other margin, and thereby avoiding need for any other kind of securing means for said ring plates.

6. Structure according to claim 5, wherein said refining disk comprises material having a high strength to modulus of elasticity ratio selected from fiberglass, fiberglass/epoxy composite, spring stainless steel, and said refining plate rings comprise a hard and relatively inflexible resistant material selected from ni-hard stainless steel and ceramic.

7. Structure according to claim 5, wherein said one margin of the disk is at the radially inner perimeter of the disk, and said opposite margin is at the radially outer perimeter of the disk.

8. Structure according to claim 5, wherein said one margin of the disk is at the radially inner perimeter of the disk and said opposite margin is at a radially outer perimeter of the disk.

* * * * *